US010183260B2

(12) United States Patent
Wilder et al.

(10) Patent No.: US 10,183,260 B2
(45) Date of Patent: Jan. 22, 2019

(54) CARBONATION UNIT AND PROCESS FOR CARBONATING A BEVERAGE

(71) Applicant: STRAUSS WATER LTD., Petach Tikva (IL)

(72) Inventors: Haim Wilder, Ra'anana (IL); Eyal Krystal, Kfar Saba (IL)

(73) Assignee: STRAUSS WATER LTD., Petach Tikva (IL)

( * ) Notice: Subject to any disclaimer, the term of this patent is extended or adjusted under 35 U.S.C. 154(b) by 318 days.

(21) Appl. No.: 15/032,086

(22) PCT Filed: Jan. 14, 2015

(86) PCT No.: PCT/IL2015/050047
§ 371 (c)(1),
(2) Date: Apr. 26, 2016

(87) PCT Pub. No.: WO2015/118523
PCT Pub. Date: Aug. 13, 2015

(65) Prior Publication Data

US 2016/0256837 A1 Sep. 8, 2016

Related U.S. Application Data

(60) Provisional application No. 61/936,359, filed on Feb. 6, 2014.

(51) Int. Cl.
*B01F 3/04* (2006.01)
*B67D 1/00* (2006.01)

(52) U.S. Cl.
CPC ..... *B01F 3/04808* (2013.01); *B67D 1/0066* (2013.01); *B01F 2003/049* (2013.01); *B67D 1/0061* (2013.01)

(58) Field of Classification Search
CPC ..... B01F 3/04808; B01F 2003/049; B67D 1/0066; B67D 1/0061
See application file for complete search history.

(56) References Cited

U.S. PATENT DOCUMENTS 1,730,142 A * 10/1929 Henderson ..... B67D 1/04 220/502
3,730,500 A 5/1973 Richards
4,304,736 A * 12/1981 McMillin ..... B01F 3/0473 222/129.1
5,037,584 A * 8/1991 Toll ..... B01F 3/04787 261/76
5,118,010 A * 6/1992 Jeans ..... B67D 1/0052 116/DIG. 32

(Continued)

FOREIGN PATENT DOCUMENTS

CN 1537028 10/2004
CN 102803121 8/2015

(Continued)

OTHER PUBLICATIONS

International Search Report issued in International Appl. No. PCT/IL2103/050768, dated May 22, 2014.

*Primary Examiner* — Anthony J Weier
(74) *Attorney, Agent, or Firm* — Dorsey & Whitney LLP

(57) ABSTRACT

A carbonation unit which includes a carbonation chamber and an expansion chamber is employed for use in beverage dispensers. The carbonation unit also provides a process for carbonation of a beverage that includes reducing the pressure in the carbonation chamber to a dispensing pressure through the use of the gas expansion chamber.

18 Claims, 6 Drawing Sheets

(56) References Cited

U.S. PATENT DOCUMENTS

| | | | | | |
|---|---|---|---|---|---|
| 5,251,789 | A | * | 10/1993 | Jeans | B67D 1/0052 137/170.1 |
| 5,503,659 | A | | 4/1996 | Crosman | |
| 5,992,684 | A | | 11/1999 | Russell | |
| 6,216,913 | B1 | | 4/2001 | Bilskie et al. | |
| 7,114,707 | B2 | | 10/2006 | Rona et al. | |
| 7,861,550 | B2 | | 1/2011 | Knoll et al. | |
| 7,987,769 | B2 | | 8/2011 | Oranski et al. | |
| 8,623,206 | B2 | | 1/2014 | Wilder | |
| 2015/0225221 | A1 | | 8/2015 | Wilder | |

FOREIGN PATENT DOCUMENTS

| | | | |
|---|---|---|---|
| CN | 102803211 | | 1/2016 |
| DE | 2358591 | A1 | 5/1975 |
| EP | 0223209 | A2 | 5/1987 |
| EP | 0867219 | A1 | 9/1998 |
| EP | 1579906 | A1 | 9/2005 |
| EP | 2664880 | | 11/2013 |
| FR | 89935 | E | 9/1967 |
| WO | 2002081067 | A2 | 10/2002 |
| WO | 2003048027 | A2 | 6/2003 |
| WO | 2003098136 | A1 | 11/2003 |
| WO | 2006092783 | A2 | 9/2006 |
| WO | 2007017864 | A2 | 2/2007 |
| WO | 2008026208 | A2 | 3/2008 |
| WO | 2010056486 | A2 | 5/2010 |
| WO | 2011030339 | A2 | 3/2011 |
| WO | 2011030340 | A2 | 3/2011 |
| WO | 2012110885 | A1 | 8/2012 |
| WO | 2014041539 | A2 | 3/2014 |

* cited by examiner

CARBONATION UNIT AND PROCESS FOR CARBONATING A BEVERAGE

TECHNOLOGICAL FIELD

The present disclosure concerns a carbonation unit for carbonating a dose of a beverage.

BACKGROUND ART

References considered to be relevant as background to the presently disclosed subject matter are listed below:

PCT application having the publication number WO 2014/041539

PCT application having the publication number WO 2012/110885

Acknowledgement of the above references herein is not to be inferred as meaning that these are in any way relevant to the patentability of the presently disclosed subject matter.

BACKGROUND

Beverage dispensers, including those intended to dispense a cold beverage, are widely known used. Also known are beverage dispensers including a carbonation unit and adapted to dispense a carbonated beverage, at times also in addition to a non-carbonated beverage.

PCT application having Publication No. WO 2014/041539 discloses a beverage dispenser for on-demand preparation of carbonated beverages, as well as processes for preparing and dispensing carbonated beverages upon user-demand.

PCT application having Publication No. WO 2012/110885 discloses a device for supplying water and soda.

GENERAL DESCRIPTION

The current disclosure provides a novel carbonation unit for use in beverage dispensers. The current disclosure also provides a new carbonation process and further provides a beverage dispenser including a carbonation unit of this disclosure.

The term "beverage" refers to any aqueous drinking liquid that may be carbonated to produce a carbonated beverage. It includes, for example, but not limited to, water, flavored-water, milk, alcohol-containing drink, etc.

One of the features of the carbonation unit of this disclosure is the inclusion of an expansion chamber that is linked to the carbonation chamber. The link is typically through an opening at the upper end of the carbonation chamber, where, in use, there is a small head-space above the surface of the beverage within the carbonation chamber. Carbonation of the beverage in the carbonation chamber is through the introduction of pressurized carbon dioxide. As can be understood, once pressurized carbon dioxide is introduced into the carbonation chamber, the pressure inside the chamber increases substantially to that of the introduced pressurized carbon dioxide. This carbonation pressure is relatively high in order to ensure effective carbonation. If then the carbonated beverage will be dispensed, the high pressure remaining in the carbonation chamber will force the beverage out in a relatively violent manner and as a results it will be dispensed in a strong stream which may cause undesired splashes and laud noise. The provision of an expansion chamber and the inclusion of an expansion phase may, at least partially, obviate this issue.

During carbonation, the link between the carbonation chamber and the expansion chamber is closed. Following carbonation, the link may be opened, permitting expansion of the pressurized gas giving rise to a pressure reduction to a lower pressure referred to herein as the "dispensing pressure". As can be appreciated, the dispensing pressure is a product of (i) the carbonation pressure, (ii) the volume of the head-space and (iii) the volume of the expansion chamber. As can also be appreciated, variation in the working parameters, such as the carbon dioxide pressure or the volume of the head-space remaining after filling the carbonation chamber with the non-carbonated beverage, may result in some variations in the dispensing pressure between one operation cycle of the carbonation unit to another. It is the dispensing pressure which then propels the carbonated beverage out of the carbonation chamber, and then through to and out of a beverage dispensing outlet that is linked to the beverage outlet of the carbonation chamber (typically located at a bottom end of the carbonation chamber). The lower propelling force of the dispensing pressure permits a smoother outflow of the beverage through the dispensing outlet.

The inclusion of an expansion chamber permits also a more efficient utilization of the carbonation chamber. In prior art carbonation units there was typically a need, through design or through defined operational parameters, to provide for a significant head-space in the carbonation chamber above the beverage to permit an eventual pressure reduction through an auxiliary, pressure-release mechanism. In the carbonation unit of this disclosure, the head-space can be kept to a minimum and thus the overall dimension of the carbonation chamber may be reduced; or, seeing it in another way, the amount of carbonated beverage that is prepared and can be dispensed is very close to the volume of the carbonation chamber.

The carbonation unit, by some embodiments of this disclosure, typically has two concentric chambers (one enveloping the other), of which one is a cooling chamber and the other is the carbonation chamber, as will be described below.

A carbonation unit provided by a first aspect of this invention comprises a carbonation chamber and an expansion chamber. The carbonation chamber has a beverage inlet for introducing beverage into the carbonation chamber; a pressurized gas inlet for introducing carbon dioxide into the carbonation chamber that typically ends with a nozzle that in use is immersed in the beverage within the carbonation chamber; an expansion outlet, typically at the upper end of the carbonation chamber; and a carbonated beverage outlet, typically at a bottom end of the chamber. The expansion chamber is linked to the expansion outlet through a sealable conduit. This conduit is sealed during carbonation, e.g. by a valve disposed within the conduit, and is opened thereafter.

The unit may operate in a duty cycle that comprises (i) a carbonation phase, in which pressurized carbon dioxide is introduced into the carbonation chamber to produce a carbonated beverage; and (ii) an expansion phase, after conclusion of the carbonation phase, in which the expansion link is opened. The carbonated beverage can then be dispensed, in a dispensing phase, out of the carbonated beverage outlet towards and through a beverage dispensing outlet, the dispensing pressure inducing the force that propels the carbonated beverage in this dispensing phase.

The duty cycle is typically controlled by an electronic control module that can be a part of or associated with the carbonation unit.

During use, some pressurized gas flows from the carbonation chamber into the expansion chamber, which gas may include droplets or humidity/moisture, which may bring to some build up and/or condensation of liquid within the expansion chamber. Thus, according to an embodiment of this disclosure, the expansion chamber comprises a draining outlet for draining such liquid. According to this embodiment, the duty cycle typically comprises opening the draining outlet at the end of or following the dispensing phase.

By an embodiment of this disclosure, the carbonation unit comprises an integral cooling arrangement. While it is possible, by some embodiments of this disclosure, to include a cooling element within the carbonation chamber (in which case there may be a need to provide some time, prior to carbonation or prior to dispensing for cooling the beverage within the carbonation chamber), the cooling arrangement is typically embodied in a cooling chamber, comprising or being associated with a cooling element. The beverage to be carbonated passes through the cooling chamber, and thereby cooled, before entering the carbonation chamber.

By an embodiment of this disclosure, the cooling chamber and the carbonation chamber are formed as two concentric chambers that are in liquid communication with one another, of which a second chamber envelopes, a first chamber. Typically, the enveloping chamber is the cooling chamber and comprises a cooling element (for example, a helical cooling element) that is in direct contact with the beverage within the cooling chamber. Typically, the first and second chambers are separated by a heat-conducting wall, typically a thin metal wall. Through this arrangement, also the beverage in the carbonation chamber is continuously cooled.

By some embodiments of this disclosure, the expansion chamber is integrally formed with the two concentric chambers constituting together one integral body.

The carbonation unit may also comprise an initialization vent which permits release of air from within the unit to prevent back-pressure upon filling with the beverage. The vent is typically formed on a conduit linking the cooling chamber and the carbonation chamber.

A second aspect of this disclosure provides a process for producing a carbonated beverage, comprising introducing a non-carbonated beverage into a carbonation chamber; introducing pressurized carbon dioxide into the carbonation chamber and maintaining pressure for a time sufficient to carbonate the beverage; linking an upper end of the carbonation chamber to an expansion chamber to thereby cause reduction in pressure to a dispensing pressure; and propelling the beverage out from the carbonation chamber, the force propelling the beverage being induced by the dispensing pressure.

The steps in the above sequence may be repeated a few times in succession. This sequence may also comprise a step of draining the liquid out of the expansion chamber that follows the propelling step. In the event of repeated cycles, said draining step may be carried out only once every few cycles; i.e. not necessarily after each step of propelling.

Provided by a third aspect of the invention, is a beverage dispenser that comprises a unit of the type disclosed herein.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which:

FIGS. 1A, 1B, and 1C are external views of a carbonation unit according to an embodiment of this disclosure, wherein FIG. 1A is a perspective view from above; FIG. 1B is a perspective view from below; and FIG. 1C is a top elevation.

DETAILED DESCRIPTION OF EMBODIMENTS

Figure 1A:
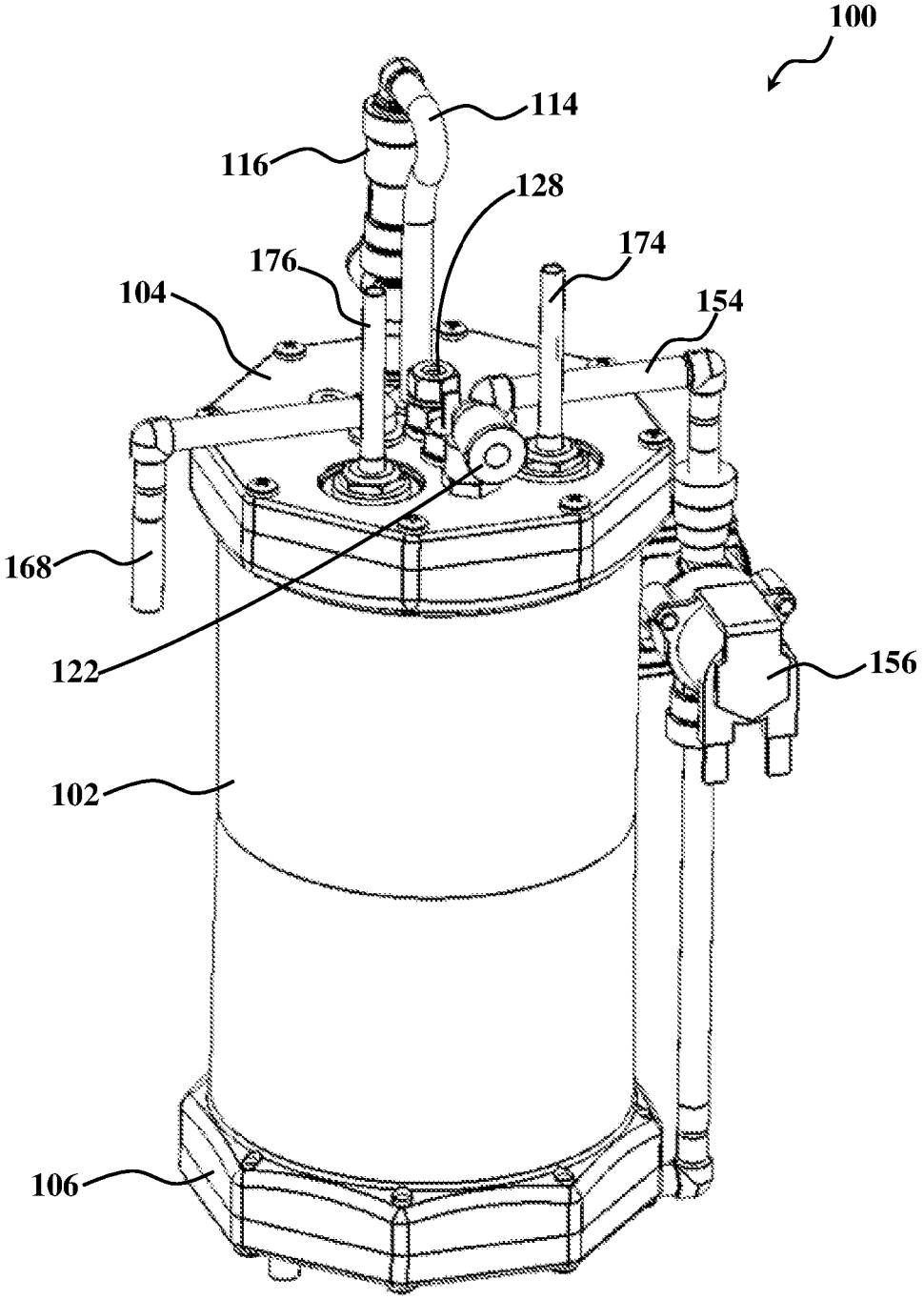
Figure 1B:
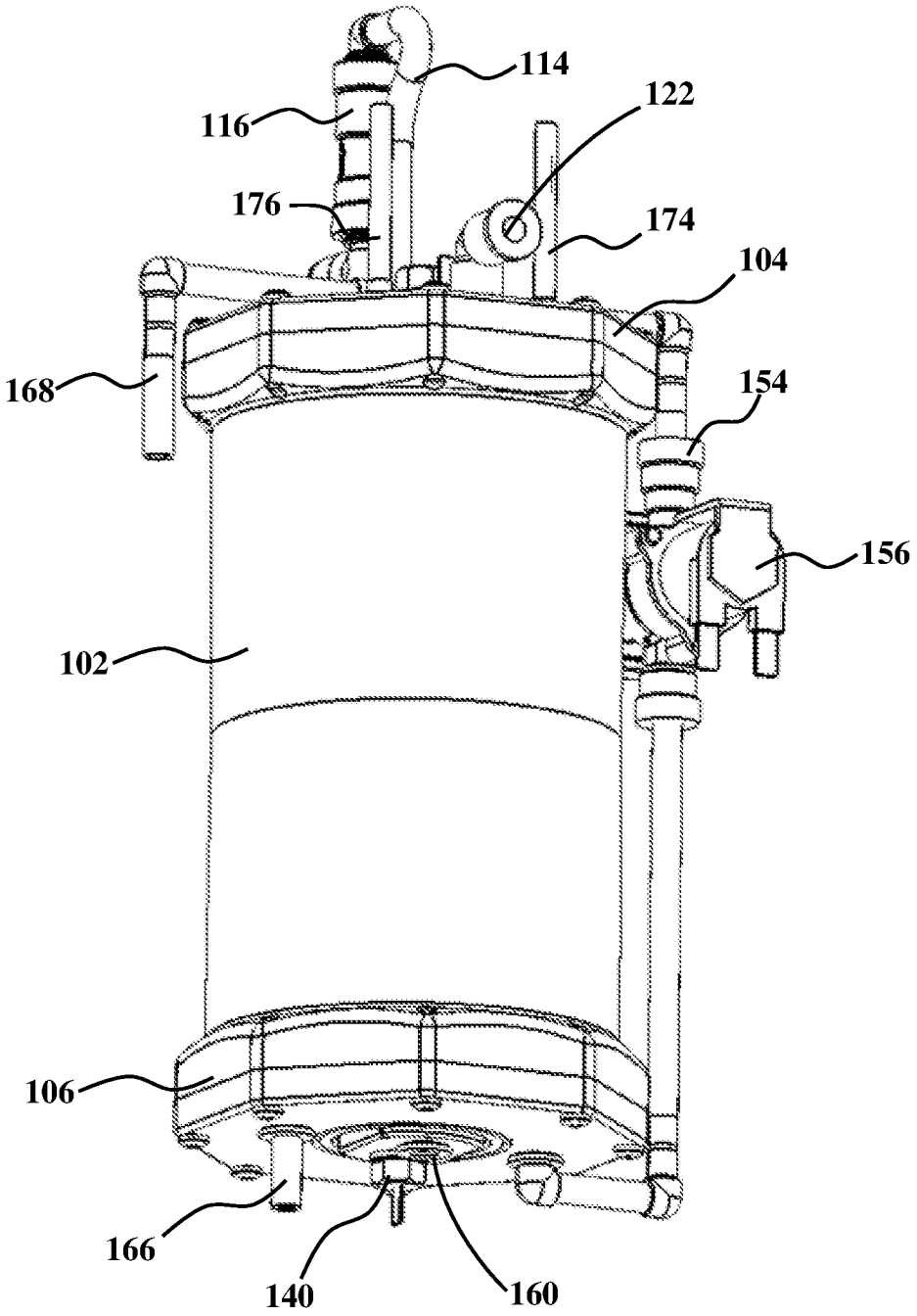
Figure 1C:
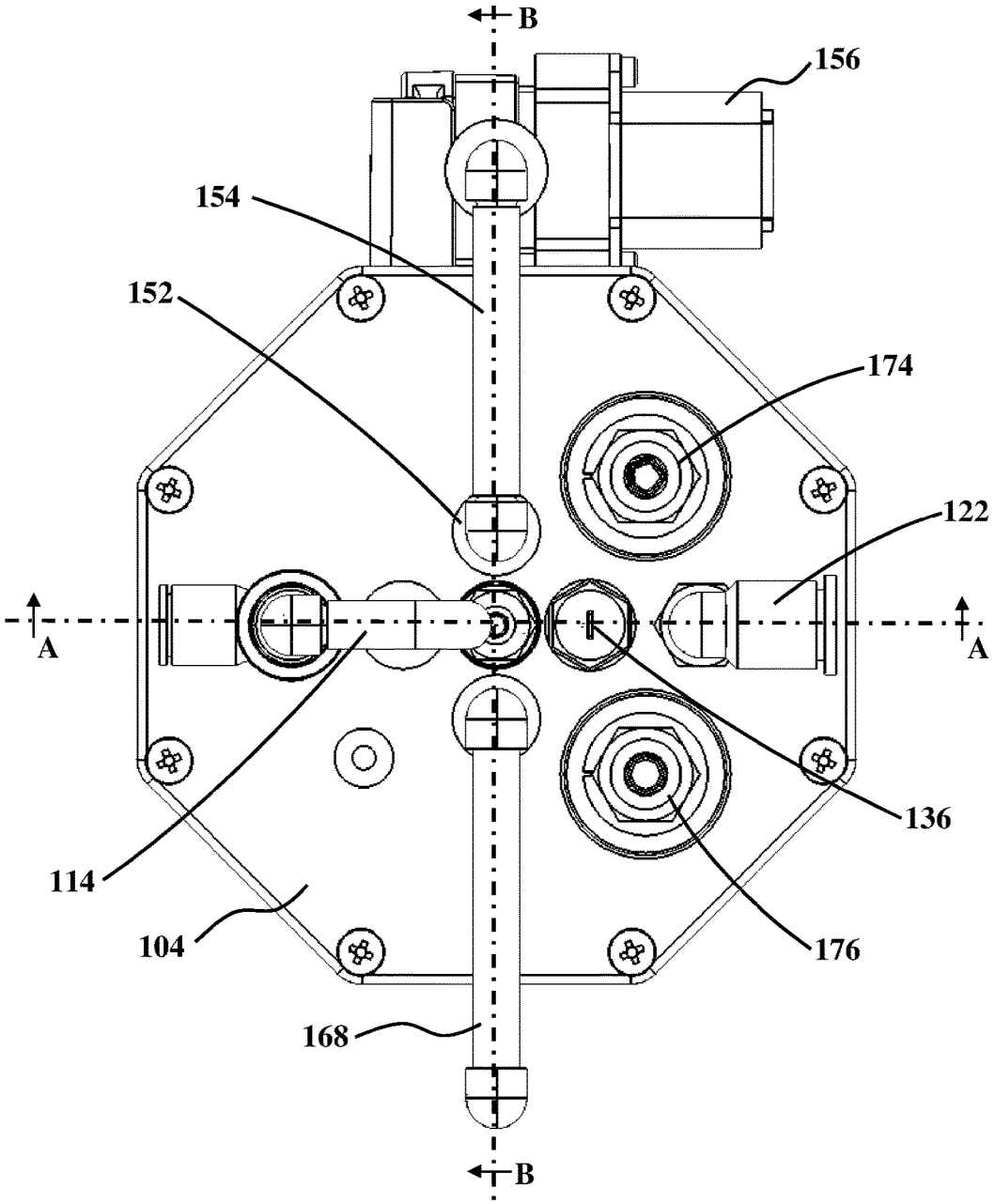

FIGS. 1A-2B include schematic representations of several views of a carbonation unit according to an embodiment of this disclosure. As is no doubt clear to a person versed in the art, the described unit is only an example and this disclosure is by no means limited to this embodiment.

While the carbonation unit of this disclosure is in principle usable for carbonating any type of beverage, a typical beverage is water. Thus, in the following description the unit will be described with reference to water as the beverage that is being carbonated, it being understood that this is illustrative and not intended to be limiting. As can be appreciated, the beverage may also be other than water, such as flavored water, alcoholic beverages, natural juices, etc.

Unit 100, shown in FIGS. 1A-2B, includes body 102 extending between an upper base plate 104 and a bottom base plate 106. The body and base plates may be made of plastic materials, metal, other polymeric materials, ceramics, etc. The unit has two concentric chambers including a carbonation chamber 108 enveloped by a cooling chamber 110. The carbonation chamber has a water inlet 112, linked to the cooling chamber 110 through conduit 114 that extends from a port 118 within cooling chamber 110 and is fitted with a valve element 116. In use, once valve 116 is opened, a link is established between the cooling chamber 110 and the carbonation chamber 108 to permit cooled water to flow out of the cooling chamber into the carbonation chamber. Conduit 114 is fitted with vent 120 which permits, when needed (for example after first filling or during use), to release gas (e.g. air or vapor) which may be entrapped within the cooling chamber and which, if not released, may have an effect on the proper operation of the unit.

FIGS. 1A-2B show the unit in isolation. In use, the unit is linked to other functional components including, among others, a water source and a source of pressurized carbon dioxide. These additional elements are illustrated schematically as boxes in FIG. 2A or 2B.

The cooling chamber has a water entry port 122 which is linked to a water source 124, typically a water line or a water reservoir. The force that propels the flow of the water into the unit, i.e. its entry into the cooling chamber, and then its flow from there to the carbonation chamber, may be by a pump (not shown) fitted onto line 126 that feeds the water into port 122; or where source 124 is the water line it may be the pressure within the water line. Where the propelling force is a pump, its activation may coincide with the opening of valve 116.

The carbonation chamber has also a pressurized gas inlet 128 that in use is linked to a pressurized carbon dioxide source 130. The pressurized gas inlet 128 ends with a nozzle 132 that, in use, is immersed within the water in the carbonation chamber. In this specific embodiment, the carbonation chamber 108 is filled with water up to about line 134, the level being controlled by a liquid sensor 136. Another liquid sensor 140 is found at the bottom end of the unit, fitted within bore 141 formed in a plug member 142 that is inserted into the central bore of bottom base plate 106.

Plug member 142 is fitted with two O-rings 144 that ensure a liquid-tight seal. Once liquid sensor 136 becomes immersed in the water, an electrical circuit is closed between sensor 136 and sensor 140 through the water, thereby issuing a signal to a control unit (not shown) that consequently causes valve 116 to shut off. Thus, in use, there is a water-free head-space 138 that remains within the carbonation chamber after filling the chamber with water to be carbonated.

Unit 100 also includes an expansion chamber 150 linked to expansion outlet 152 of the carbonation chamber through expansion link 154 which is sealable by a valve element 156 fitted thereon. The carbonation chamber also includes a carbonated water outlet 160 which is linked through conduit 162, fitted with a valve element 163 to a carbonated water dispensing outlet, shown schematically as block 164. Valve 163 is closed during carbonation but is opened to permit dispensing of the carbonated water out of outlet 164 by the force of the dispensing pressure remaining within the carbonation chamber after the expansion phase (see below).

The expansion chamber 150 is formed in the bottom base plate 106 and has an annular shape defined around plug 142. Expansion chamber 150 has a draining outlet 166, which in use is linked to a valve (not shown) that may be opened at a suitable time during the operational cycle (see below) to drain liquid that may have accumulated in the chamber as a result of condensation or accumulation of aerosol droplets.

Figure 2A:
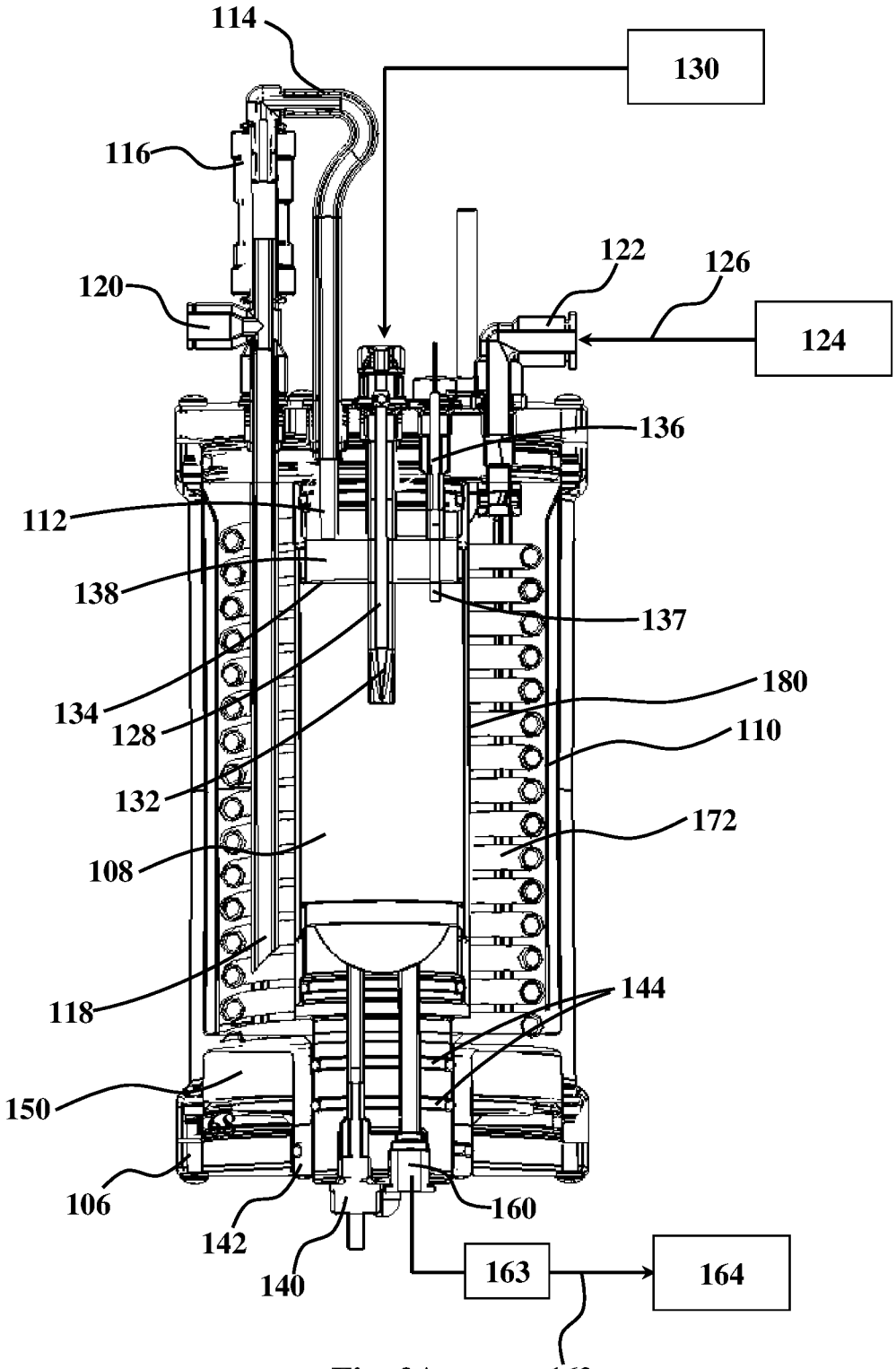
FIGS. 2A and 2B are longitudinal cross-sections along respective lines A-A and B-B, seen in FIG. 1C.
Figure 2B:
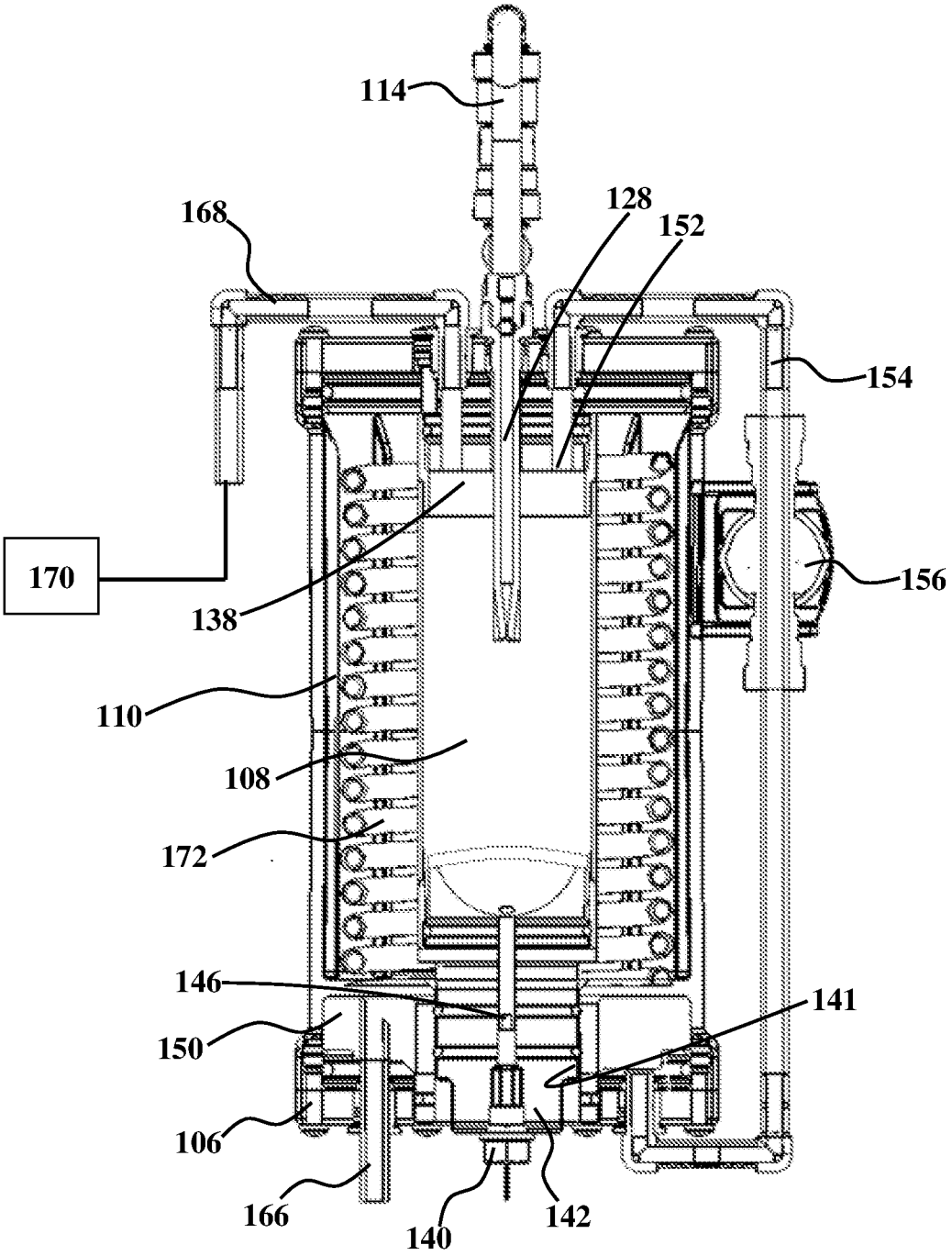

The carbonation chamber is also fitted with a conduit 168 which is linked to a pressure gauge, shown schematically as block 170 in FIG. 2B. Pressure gauge 170 monitors pressure and is designed to release pressure in the event that the pressure within the carbonation chamber rises beyond a defined maximal pressure, for operational safety.

The operational cycle of the unit may controlled by a control module (not shown) linked to the different valves or pumps of the system. The operational cycle may include a number of phases.

As can also be seen in FIGS. 2A and 2B, embedded within the cooling chamber 110 is a helical cooling element 172 in which a cooling fluid circulates between cooling fluid inlet 174 and cooling fluid outlet 176. The cooling fluid may be a gas or a liquid. The cooling fluid is cooled by a refrigeration unit which may be, for example, that disclosed in U.S. Pat. No. 7,645,381 or that subject of PCT publication serial no. WO 2011/030339. The cooling chamber 110 and the carbonation chamber 108 are separated by a heat conducting wall 180, typically a thin metal wall. Thus, through the mediation of the heat conducting wall 180 also the water in the carbonation chamber will be continuously cooled.

Figure 3:
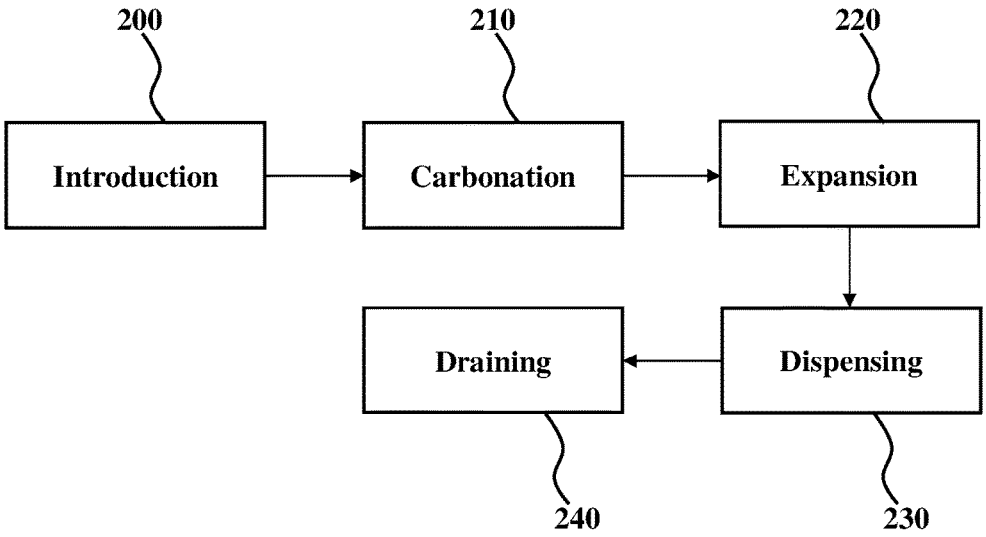
FIG. 3 shows a schematic block diagram illustrating the operational cycle of the unit of FIGS. 1A-2B.

The operational cycle of the unit disclosed in FIGS. 1A-2B is represented by a block diagram in FIG. 3. For ease of description, the different phases of the operational cycle in the description below are defined as first phase, second phase, etc. However, the phase designation has no functional significance as all phase occur in succession and each of the phases may in principle be regarded as first.

At a first phase 200, water that was cooled in the cooling chamber 110 is introduced into the carbonation chamber 108. For this, valve 116 is opened and in the event that the entire dispensing device or system in which the unit is included includes the propelling pump (fitted on line 126) it is also activated. The filling continues up to a point where sensing tip 137 of sensor 136 becomes immersed in the liquid, issuing a signal that induces cessation of water flow, namely, shutting off valve 116 and if existing and operating also shutting off said pump.

In the second phase 210, a valve (not shown) controlling release of carbon dioxide from the carbon dioxide source 130 is opened to permit pressurized carbon dioxide to enter the carbonation chamber through nozzle 132. The pressure is maintained for a time, typically a few seconds, to ensure effective carbonation.

In the third phase, valve 156 is operated thereby establishing a link between head-space 138 and expansion chamber 150 which brings the pressure in the unit down to a dispensing pressure.

At the fourth phase, line 162 is opened to permit dispensing of the carbonated water out of dispensing outlet 164 by the force of the dispensing pressure. This dispensing phase is terminated once the carbonation chamber is entirely emptied, whereupon sensor 140 issues the appropriate signal (or ceases to issue such a signal) to induce closure of the valve controlling flow out of line 162.

In a fifth optional phase, draining outlet 166 drains the accumulated liquid.

The water dispenser typically includes an activation button and the operational cycle proceeds automatically upon such activation. The fifth phase of drainage, may be repeated in every cycle or alternatively once in a few cycles.

The invention claimed is:

1. A carbonation unit, comprising a carbonation chamber having a beverage inlet for introducing beverage into the carbonation chamber, a pressurized gas inlet for introducing pressurized carbon dioxide into the carbonation chamber, a gas expansion outlet at an upper end of the carbonation chamber, and a carbonated beverage outlet; and a gas expansion chamber configured for expansion of gas therein, the gas expansion chamber linked to the gas expansion outlet through a sealable expansion link configured to selectively open and close, the gas expansion chamber linked to the gas expansion outlet to receive gas from an upper end of the carbonation chamber when the sealable expansion link is open without receiving carbonated beverage from the carbonation chamber effective to reduce gas pressure in the carbonation chamber.

2. The carbonation unit of claim 1, being configured for operating in a duty cycle comprising (i) a carbonation phase in which pressurized carbon dioxide is introduced into the carbonation chamber to produce a carbonated beverage, and (ii) an expansion phase, after conclusion of the carbonation phase, in which the expansion link is opened to reduce the gas pressure in the carbonation chamber.

3. The carbonation unit of claim 1 wherein the expansion phase causes the reduction of pressure to a dispensing pressure and the duty cycle comprises (iii) a dispensing phase in which the carbonated beverage is dispensed through the carbonated beverage outlet by the force of the dispensing pressure.

4. The carbonation unit of claim 1, wherein the expansion chamber comprises a draining outlet for draining liquid therefrom.

5. The carbonation unit of claim 3, wherein the draining outlet is opened at the end of or following the dispensing phase.

6. The carbonation unit of claim 2, comprising or being associated with a control module for controlling the duty cycle.

7. The carbonation unit of claim 1, wherein the pressurized gas inlet has a nozzle that, in use, is immersed in the beverage within the carbonation chamber.

8. The carbonation unit of claim 1, wherein the beverage outlet is positioned at a bottom end of the carbonation chamber.

9. The carbonation unit of claim 1, comprising an integral beverage cooling unit.

10. The carbonation unit of claim 9, comprising two concentric chambers in liquid communication with one another, of which a second chamber envelops a first chamber, one of said chambers being a cooling chamber and the other being said carbonation chamber.

11. The carbonation unit of claim 10, wherein said first chamber is the carbonation chamber and said second chamber is the cooling chamber, optionally wherein (i) the two chambers are separated by a heat-conducting wall, and/or (ii) the carbonation unit comprises a cooling element within said cooling chamber.

12. The carbonation unit of claim 10, wherein the expansion chamber is integral with the two concentric chambers.

13. The carbonation unit of claim 10, comprising an initialization vent for permitting release of residual gas from within the unit, optionally wherein the vent is linked to a duct that links the first and second chambers.

14. A process for carbonating a beverage, comprising:

(a) introducing beverage into a carbonation chamber;

(b) introducing pressurized carbon dioxide into the carbonation chamber under pressure and for a time sufficient to carbonate the beverage;

(c) linking an upper end of the carbonation chamber to a gas expansion chamber to permit flow of gas from a head space formed above the beverage to the gas expansion chamber, thereby cause reduction in pressure within the carbonation chamber to a dispensing pressure; and (d) propelling the beverage out from the carbonation chamber, the propelling force being the dispensing pressure.

15. The process of claim 14, comprising repeating the steps sequence two or more times.

16. The process of claim 14 comprising cooling the beverage introduced into the carbonation chamber.

17. The process of claim 16, wherein the beverage is cooled prior to its introduction into the carbonation chamber, optionally wherein the beverage that is introduced into the carbonation chamber egresses from a cooling chamber.

18. A beverage dispenser, comprising a carbonation unit of claim 1.

* * * * *